US010351297B2

(12) United States Patent
Van Riper et al.

(10) Patent No.: US 10,351,297 B2
(45) **Date of Patent: *Jul. 16, 2019**

(54) LIGHT WEIGHT FOLDED CORRUGATED PALLET

(71) Applicant: Preferred Packaging Solutions, Inc., Taylor, MI (US)

(72) Inventors: Craig Van Riper, Northville, MI (US); Daniel Hoppe, II, Newport, MI (US)

(73) Assignee: Preferred Packaging Solutions, Inc., Taylor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/927,244

(22) Filed: Mar. 21, 2018

(65) Prior Publication Data

US 2018/0273241 A1 Sep. 27, 2018

Related U.S. Application Data

(60) Provisional application No. 62/474,162, filed on Mar. 21, 2017.

(51) Int. Cl.
*B65D 19/00* (2006.01)
*B65D 19/38* (2006.01)
*B65D 19/20* (2006.01)

(52) U.S. Cl.
CPC ..... *B65D 19/0018* (2013.01); *B65D 19/0012* (2013.01); *B65D 19/0073* (2013.01);
(Continued)

(58) Field of Classification Search
CPC ..... B65D 19/0018; B65D 19/0012; B65D 19/20; B65D 19/385; B65D 19/0028;
(Continued)

(56) References Cited

U.S. PATENT DOCUMENTS 2,444,183 A 6/1948 Cahners
2,493,562 A * 1/1950 Yarman ..... B65D 19/0026 108/51.3

(Continued)

FOREIGN PATENT DOCUMENTS

FR 2922864 A1 5/2009
GB 928141 A 6/1963
WO 2017037483 A1 3/2017

OTHER PUBLICATIONS

Non-Final Office Action issued in U.S. Appl. No. 15/927,279 dated Nov. 8, 2018.

(Continued)

*Primary Examiner* — Daniel J Troy
*Assistant Examiner* — Timothy M Ayres
(74) *Attorney, Agent, or Firm* — Howard & Howard Attorneys PLLC

(57) ABSTRACT

The invention generally relates to devices used for material handling, such as specifically, pallets and skids. More specifically, the present invention is directed toward a folded corrugated pallet including a body defined by a single sheet of corrugated cardboard. The sheet includes a plurality of scored lines extending parallel with respect to each other. The sheet is folded along the scored lines to define a plurality of legs extending in the direction of the scored lines and at least one base wall extending between each of the legs. A pair of wings extends parallel to the scored lines and away from each other when folded parallel to the base wall. A planar top panel is disposed on top of the wings and the base wall. The planar top panel and the wings cooperate to define terminal edges of the pallet that extend in cantilevered fashion adjacent one of the legs.

19 Claims, 17 Drawing Sheets

(52) U.S. Cl.
CPC ..... *B65D 19/20* (2013.01); *B65D 19/385* (2013.01); *B65D 19/0028* (2013.01); *B65D 19/0075* (2013.01); *B65D 2519/00019* (2013.01); *B65D 2519/00054* (2013.01); *B65D 2519/00089* (2013.01); *B65D 2519/00124* (2013.01); *B65D 2519/00159* (2013.01); *B65D 2519/00194* (2013.01); *B65D 2519/00273* (2013.01); *B65D 2519/00288* (2013.01); *B65D 2519/00293* (2013.01); *B65D 2519/00318* (2013.01); *B65D 2519/00323* (2013.01); *B65D 2519/00333* (2013.01); *B65D 2519/00343* (2013.01); *B65D 2519/00373* (2013.01); *B65D 2519/00432* (2013.01); *B65D 2519/00562* (2013.01)

(58) Field of Classification Search
CPC ..... B65D 19/0075; B65D 2519/00019; B65D 2519/00054; B65D 2519/00089; B65D 2519/00124; B65D 2519/00159; B65D 2519/00194; B65D 2519/00273; B65D 2519/00288; B65D 2519/00318; B65D 2519/00343; B65D 2519/00373; B65D 2519/00432; B65D 2519/00562
USPC ..... 108/53.1, 51.3
See application file for complete search history.

(56) References Cited

U.S. PATENT DOCUMENTS 2,503,240 A 4/1950 Cahners
2,576,715 A * 11/1951 Farrell ..... B65D 19/0012 108/51.3
2,928,638 A 3/1960 Parker
2,957,668 A * 10/1960 Norquist ..... B65D 19/0016 108/51.3
3,006,590 A * 10/1961 Hoag ..... B65D 19/0016 108/51.3
3,012,747 A 12/1961 Greene
3,026,015 A 3/1962 Severn
3,246,824 A 4/1966 George
3,425,367 A * 2/1969 Oravez ..... B65D 19/0012 108/51.3
3,434,435 A 3/1969 Achermann et al.
3,529,516 A * 9/1970 Pullen ..... B65D 5/4266 229/5.85
3,626,860 A 12/1971 Blatt
3,911,834 A 10/1975 Quaintance
3,952,672 A 4/1976 Gordon et al.
4,119,205 A 10/1978 Delany
4,373,929 A 2/1983 Smith
4,487,136 A 12/1984 Beckway
4,563,377 A * 1/1986 Melli ..... B65D 19/0095 108/51.3
4,714,026 A 12/1987 Yamaguchi et al.
4,864,940 A 9/1989 Dunn
4,966,084 A 10/1990 Motomaru
5,176,090 A 1/1993 Roberts et al.
5,195,440 A 3/1993 Gottlieb
5,213,050 A 5/1993 Juvik-Woods
5,230,291 A 7/1993 Juvik-Woods
5,279,423 A 1/1994 Shuert
5,285,731 A 2/1994 McIntyre
5,327,839 A 7/1994 Herring et al.
5,329,861 A 7/1994 McCarthy
5,337,680 A 8/1994 Johnston et al.
5,350,066 A 9/1994 Mendoza et al.
5,377,600 A 1/1995 Speese et al.
5,383,409 A 1/1995 Hayakawa
5,413,053 A 5/1995 Vannatta
5,452,667 A 9/1995 Lim
5,465,672 A 11/1995 Boyse et al.
5,483,875 A 1/1996 Turecek et al.
5,493,962 A 2/1996 McCarthy
5,503,085 A 4/1996 Rozek
5,528,994 A 6/1996 Iseli
5,535,668 A 7/1996 Besaw et al.
5,537,935 A 7/1996 Otaguchi et al.
5,562,048 A 10/1996 Gottlieb
5,595,125 A 1/1997 Bridges, Jr.
5,794,542 A 8/1998 Besaw
5,799,584 A 9/1998 Campbell
5,881,652 A 3/1999 Besaw
5,921,187 A 7/1999 Wang
5,996,510 A 12/1999 Harpman et al.
6,079,337 A * 6/2000 Huang ..... B65D 19/0012 108/51.3
6,135,030 A 10/2000 Besaw
6,173,658 B1 1/2001 Moberg
6,354,229 B1 3/2002 Heidtke
6,357,364 B1 3/2002 Maloney et al.
6,739,270 B1 5/2004 Sewell
7,231,879 B2 6/2007 Gordon
7,905,183 B2 3/2011 Gibson et al.
8,161,893 B2 * 4/2012 Kindellan ..... B65D 19/0012 108/51.3
8,316,779 B2 11/2012 Gordon
9,185,984 B2 * 11/2015 Henke ..... A47B 47/0008
9,394,078 B1 7/2016 Roberts
D767,849 S 9/2016 Van de Mark
D767,850 S 9/2016 Van de Mark
2002/0069796 A1 6/2002 Olvey et al.
2004/0137196 A1 7/2004 Wang
2004/0237850 A1 12/2004 Horiuchi
2005/0092214 A1 5/2005 Edell
2006/0065168 A1 3/2006 Chen
2006/0065170 A1 * 3/2006 Chen ..... B65D 19/0026 108/51.3
2006/0288913 A1 12/2006 Lo
2007/0267308 A1 11/2007 Oberliesen et al.
2008/0000396 A1 1/2008 Tabor
2009/0223420 A1 9/2009 Ferguson et al.
2009/0223421 A1 9/2009 Ferguson
2009/0223422 A1 9/2009 Monteith et al.
2009/0308289 A1 12/2009 Ferguson
2011/0132236 A1 6/2011 French et al.
2012/0312200 A1 12/2012 Monteith
2013/0032065 A1 * 2/2013 Le Monnier ..... B65D 19/0026 108/51.3
2013/0186309 A1 7/2013 Niu
2014/0130720 A1 5/2014 Nelson
2018/0141703 A1 5/2018 Herbeck et al.
2018/0273240 A1 9/2018 Van Riper et al.
2018/0273242 A1 * 9/2018 Van Riper ..... B65D 19/20

OTHER PUBLICATIONS

Non-Final Office Action issued in U.S. Appl. No. 15/927,193 dated Nov. 20, 2018.

* cited by examiner

LIGHT WEIGHT FOLDED CORRUGATED PALLET

CROSS-REFERENCE TO RELATED APPLICATIONS

The present application claims priority to and all the benefits of U.S. Provisional Application No. 62/474,162, filed on Mar. 21, 2017, which is hereby expressly incorporated herein by reference in its entirety.

BACKGROUND

1. Field of the Invention

The invention relates, generally, to devices used for material handling, and more specifically, pallets and skids. More specifically, the present invention is directed toward a folded corrugated pallet.

2. Description of the Related Art

Typically, pallets are made from wood and molded polymers, allowing them to support heavy loads and be reused more than once or twice. While wood and molded polymer pallets have generally worked for their intended purposes, they suffer from certain disadvantages. For example, these types of pallets are relatively heavy, weighing approximately forty-five pounds. The weight of the pallets becomes significant when the number of pallets needed to accompany any given shipment of goods increases. The added weight reduces fuel economy and other efficiencies in the material handling process. In addition, and notwithstanding the relatively robust weight of the wood and molded polymer pallets of the type known in the related art, they suffer from the fact that they often end up broken after use of less than six times and are not recyclable.

In the past, there have been attempts at providing corrugated cardboard pallets as a low cost alternative to wood and molded polymer pallets. However, these attempts have been largely unsuccessful because the corrugated pallets have a much lower weight capacity than that of a wood or polymer pallet. Additionally, corrugated cardboard pallets typically do not last as long as wood or polymer pallets. Thus, there remains a need for a low cost corrugated cardboard pallet with an increased weight capacity and able to be reused several times.

SUMMARY

The present invention overcomes the deficiencies in the related art in a folded corrugated pallet including a body defined by a single sheet of corrugated cardboard. The sheet includes a plurality of scored lines extending parallel with respect to each other. The sheet is folded along the scored lines to define a plurality of legs extending in the direction of the scored lines. The sheet further includes at least one base wall extending between each of the legs, and a pair of wings. Each of the wings extends parallel to the scored lines and is folded parallel to the base wall. A planar top panel of corrugated cardboard is disposed on top of the wings and the base wall. The top panel and the wings cooperate to define terminal edges of the pallet that extend in a cantilevered fashion adjacent one of the plurality of legs.

Advantages of the corrugated pallet include increased strength and durability, as well as greatly reduced weight when compared to wood or polymer pallets. The increased strength affords the pallet a greater weight capacity. The greater weight capacity allows the pallet to be used in place of more expensive wood pallets. The increased durability allows the pallet to be reused several times, which reduces costs and waste from disposed pallets. Finally, the corrugated pallets of the type contemplated by the present invention are recyclable at the end of their useful life, thereby drastically reducing the environmental impact of this material handling component.

BRIEF DESCRIPTION OF THE DRAWINGS

Other advantages of the present invention will be readily appreciated as the same becomes better understood by reference to the following detailed description when considered in connection with the accompanying drawings, wherein.

DETAILED DESCRIPTION

Figure 1:
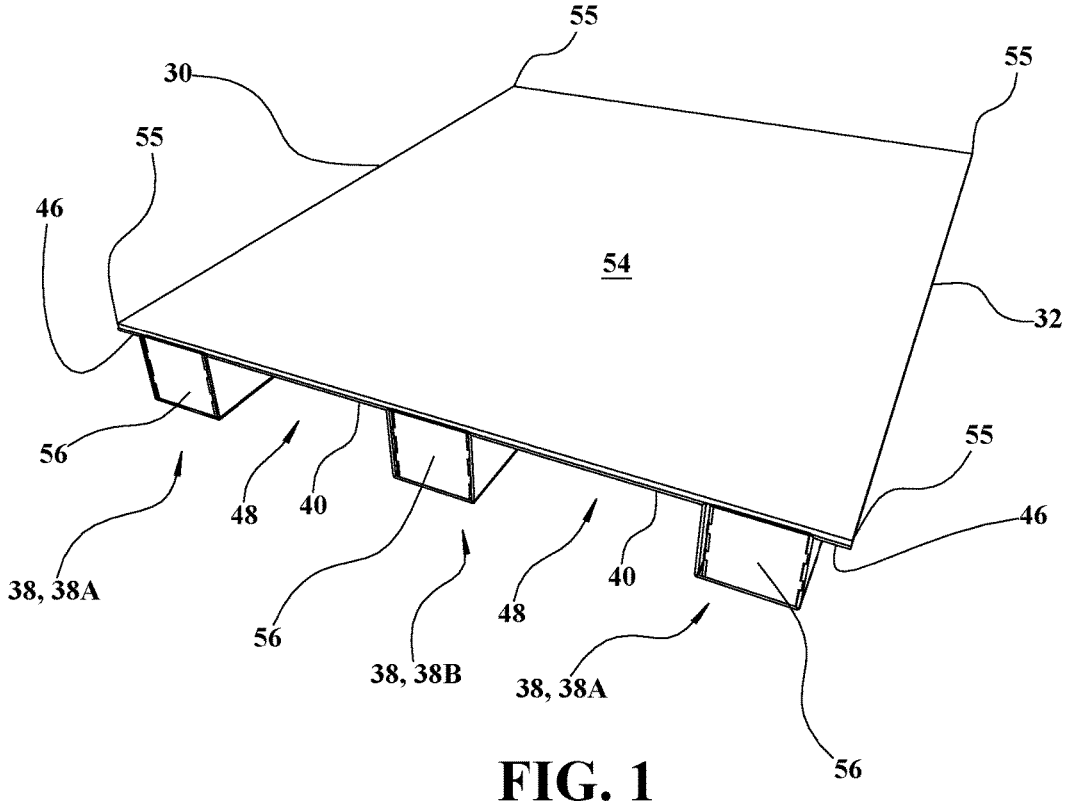
FIG. 1 is a perspective view of a folded corrugated pallet.
Figure 2:
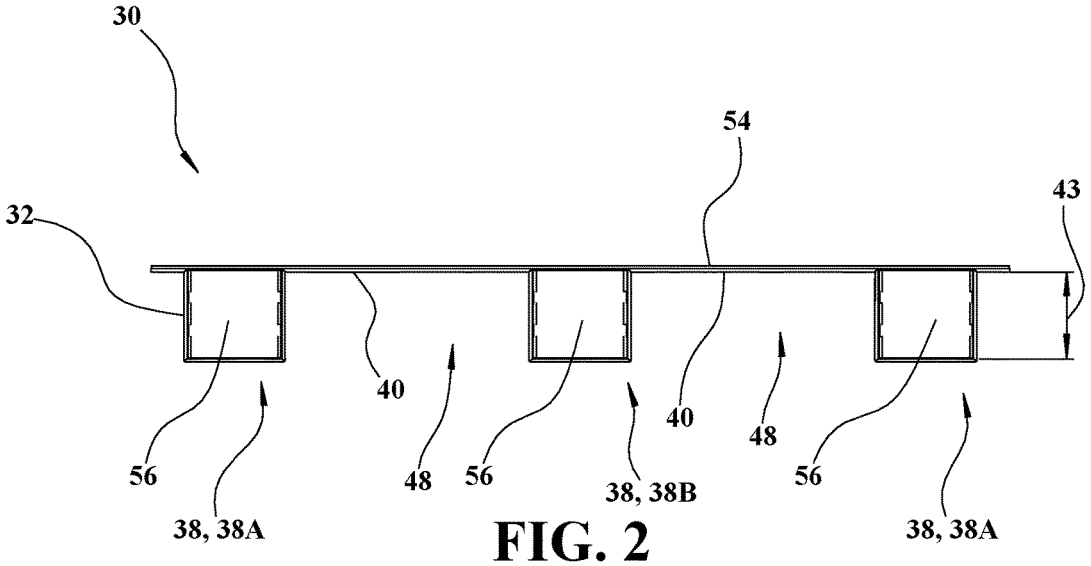
FIG. 2 is an end view of the folded corrugated pallet of FIG. 1.

With reference to the Figures, wherein like numerals indicate like parts throughout the several views, a folded corrugated pallet 30 is generally shown in FIGS. 1 and 2. As one non-limiting example, the pallet 30 may be used to support goods during transport and storage. Goods may include boxes, materials, refuse, and the like.

The pallet 30 includes a body 32 defined by a single sheet 34 of corrugated cardboard. The sheet 34 includes a plurality of scored lines 36 extending parallel with respect to each other. The sheet 34 is folded along the scored lines 36 to define a plurality of legs 38 extending in the direction of the scored lines 36. The sheet further defines at least one base wall 40 extending between each of the legs 38 and a pair of wings 42. The body 32 has a first corrugation direction 37 that may extend perpendicular to the plurality of scored lines 36.

Figure 3:
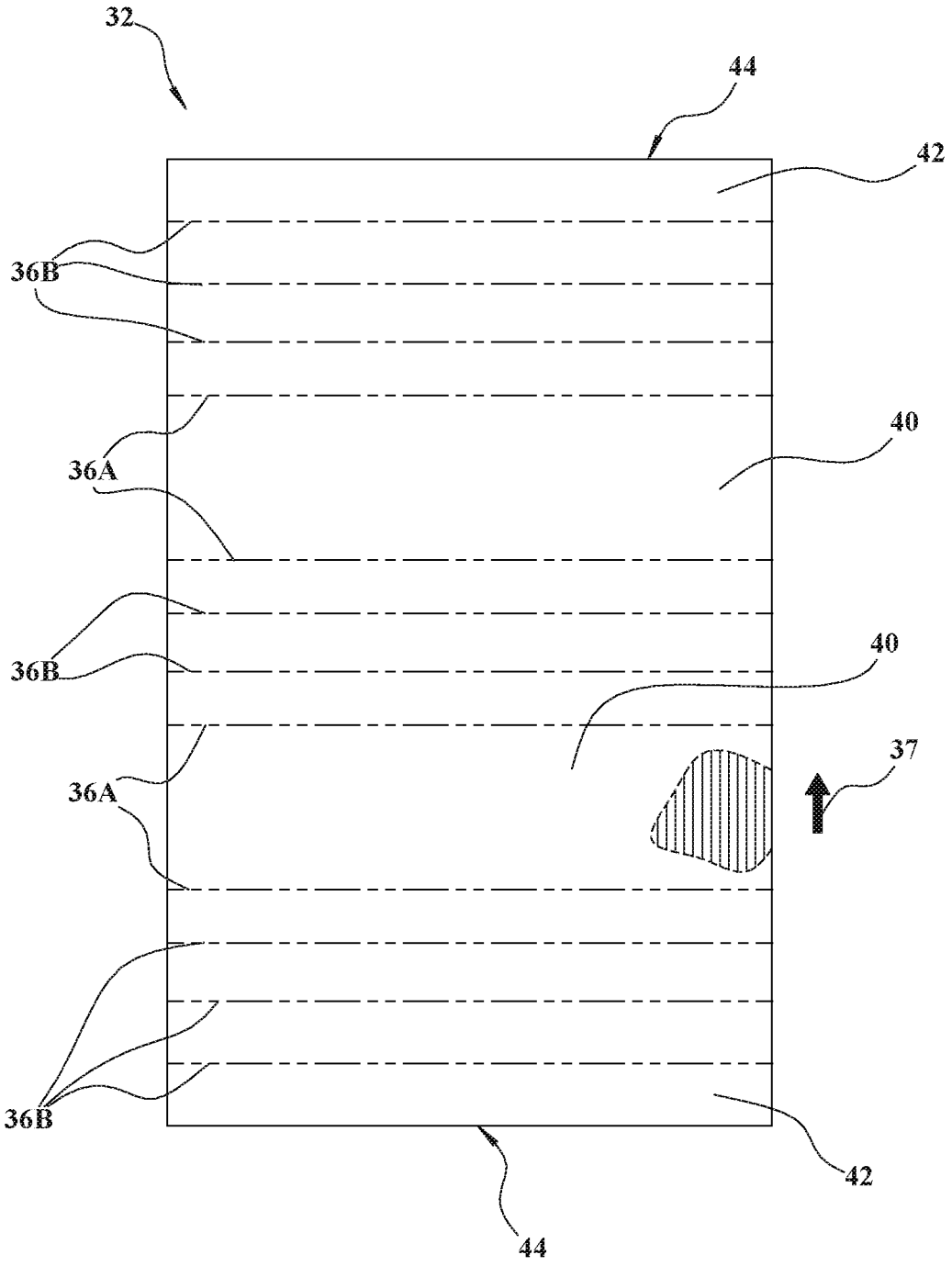
FIG. 3 is a plan view of a sheet of corrugated cardboard with scored lines according to one embodiment.

As shown in FIG. 3, the plurality of scored lines 36 are formed on the sheet 34 prior to folding. As will be discussed in more detail below, the scored lines 36 may be point-to-point scored lines. In the embodiment shown, the sheet 34 includes twelve scored lines 36. The sheet 34 is folded at each of the scored lines 36 to form the body 32 and to define three legs 38 and two base walls 40. Each leg 38 is formed from four scored lines 36. The scored lines 36 are arranged in groups of four scored lines 36 for each leg 38 that is to be formed. Those having ordinary skill in the art will appreciate that the quantity of scored lines 36 may be more or less depending on the quantity of legs 38. For example, a pallet 30 having only two legs 38 would have fewer than twelve scored lines 36, while a pallet having four legs 38 would have more than twelve scored lines 36. Each leg 38 is defined by a pair of downwardly extending side walls 39 and a bottom panel 41 parallel to the base wall 40. A height 43 of the legs 38 is defined between the bottom panel 41 and the base wall 40. The side walls 39 and bottom panel 41 each extend along the length of the scored lines 36, as will be discussed below.

In the embodiment discussed above, the base walls 40 may be further defined as a first base wall 40A, and a second base wall 40B. The legs 38 may be further defined as a pair of outer legs 38A and a center leg 38B. The pair of outer legs 38A is arranged such that each leg 38A forms one side of the pallet 30. The center leg 38B is arranged between the pair of outer legs 38A. The first base wall 40A extends between one of said outer legs 38A and said center leg 38B. The second base wall 40B extends between the other of said outer legs 38A and said center leg 38B. In other embodiments (not shown), the pallet 30 may include more than three legs 38 and therefore more than two base walls 40. In such embodiments, a base wall 40 would extend between each leg 38 to form the body 32.

The legs 38 extend downward from the body 32 and elevate the base wall 40 when the pallet 30 is placed on a surface such as a trailer, a floor surface, or the like. The body 32 defines at least one fork channel 48 arranged between each leg 38 and the base wall 40. The fork channel 48 is configured to accept forks (not shown) commonly used to lift and transport the pallet 30. Those having ordinary skill in the art will appreciate that other lifting devices may utilize the fork channel 48 in order to lift the pallet 30. By way of non-limiting example, the lifting device may be a forklift, a pallet jack, a lift table, lifting straps, and other lifting devices known in the art.

Figure 8:
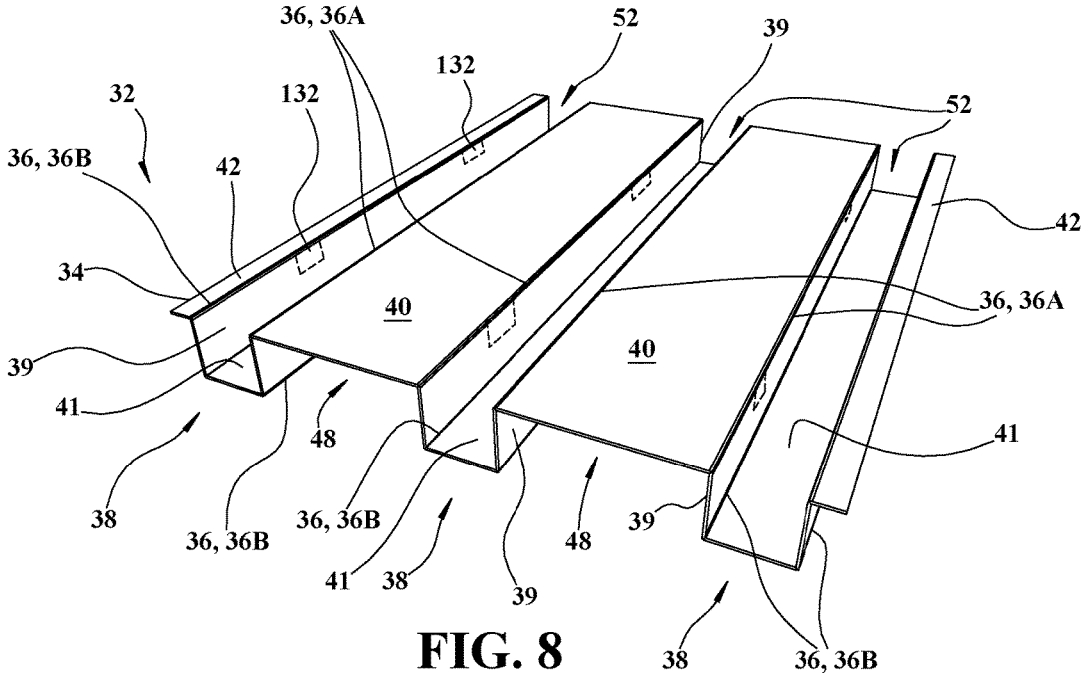
FIG. 8 is a perspective view of a body of a folded corrugated pallet according to one embodiment.
Figure 9:
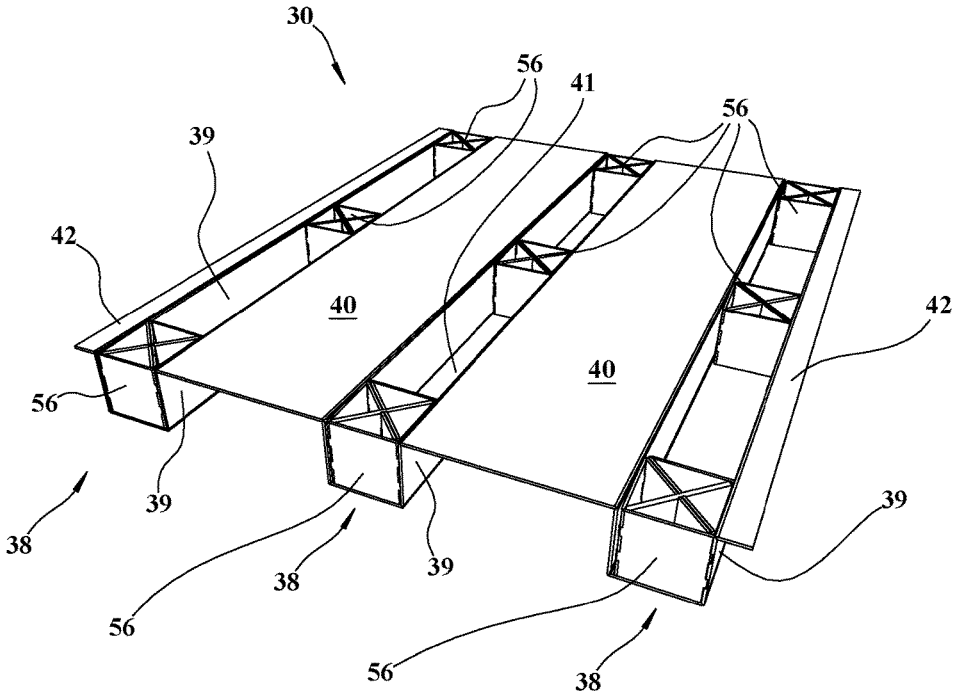
FIG. 9 is an exploded perspective view of a folded corrugated pallet including support pedestals.
Figure 10:
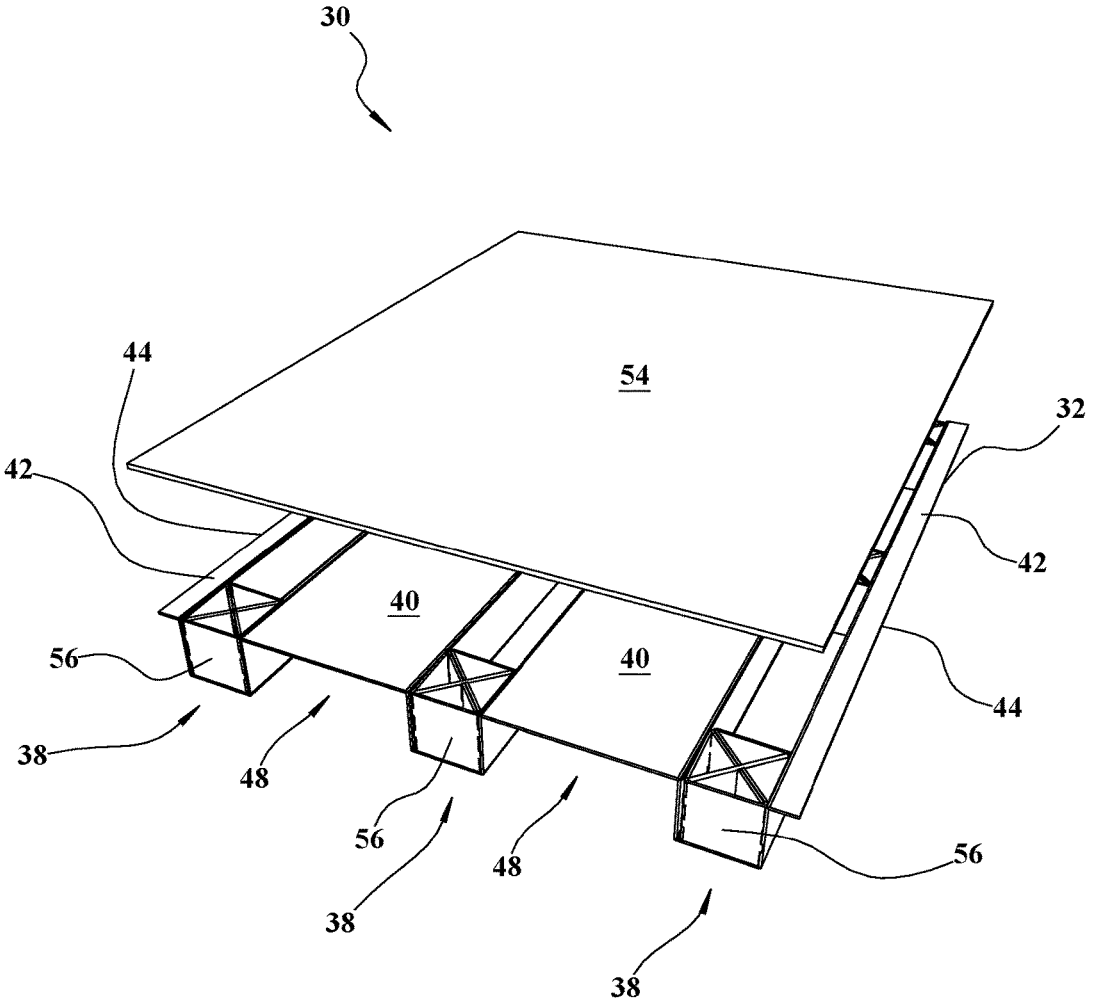
FIG. 10 is an exploded perspective view of the folded corrugated pallet of FIG. 9 including a planar top panel.
Figure 11:
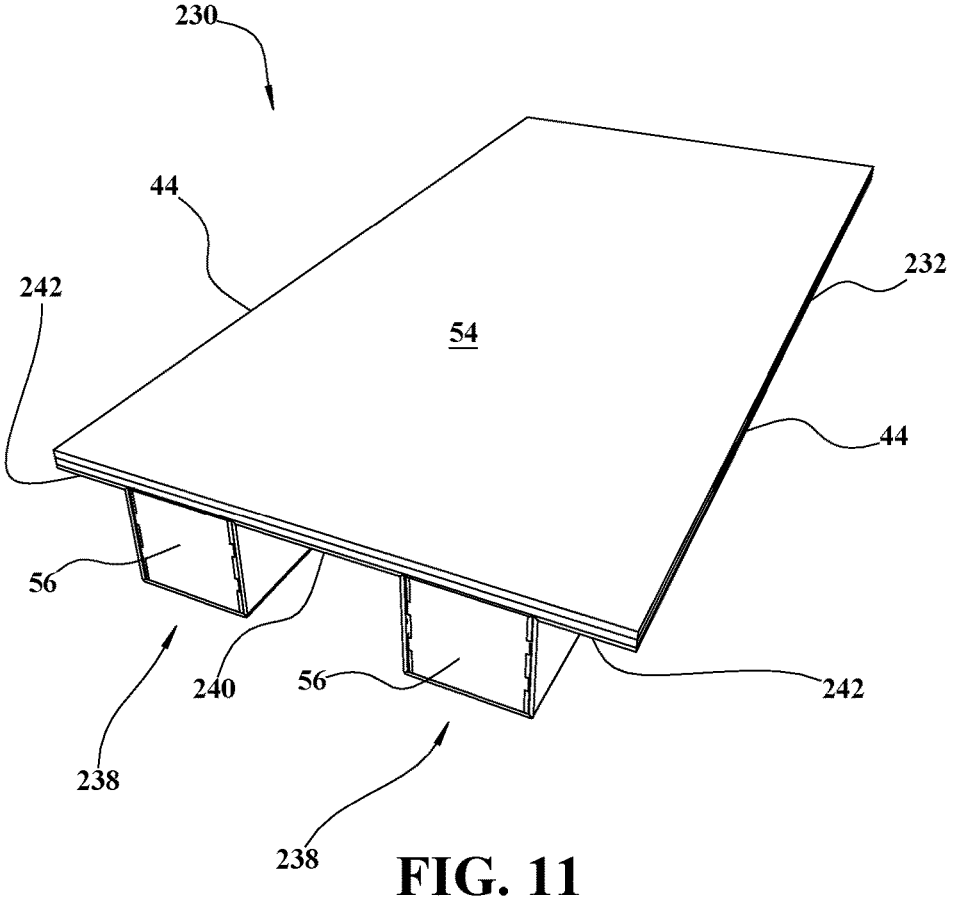
FIG. 11 is a perspective view of another embodiment of a folded corrugated pallet.
Figure 12:
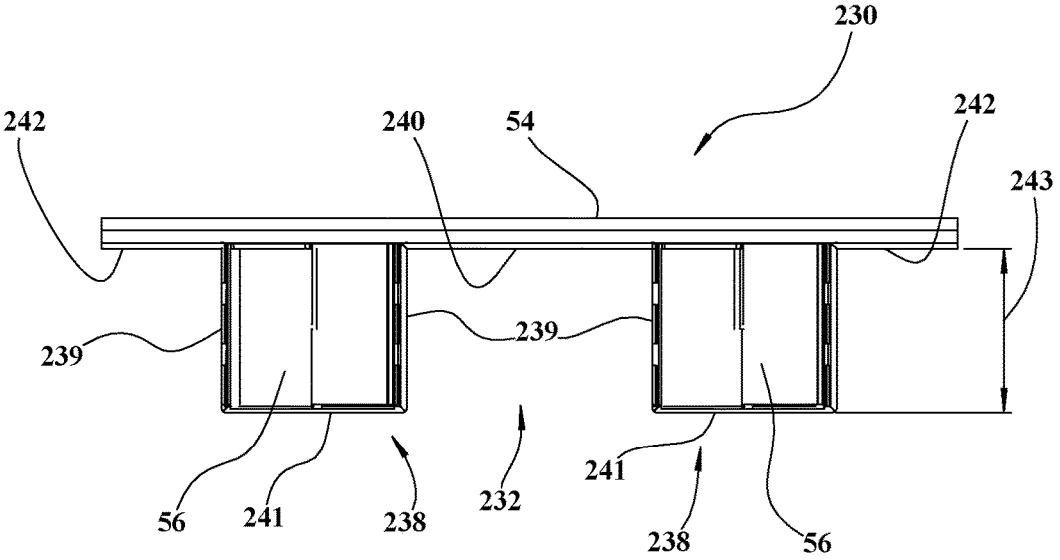
FIG. 12 is an end view of the folded corrugated pallet of FIG. 11.

Referring now to FIG. 8-10, the sheet 34 is folded along the scored lines 36 to form the body 32 and to define the legs 38 and base wall 40. As shown, each leg 38 has three sides folded to define a leg cavity 52 extending therethrough. The leg cavities 52 are open toward a top surface of the body 32 to receive a plurality of support pedestals 56. A planar top panel 54 may be disposed on top of the wings 42 and the base wall 40. The top panel 54 is supported by the base walls 40 and spans each of the leg cavities 52. The planar top panel 54 cooperates with the wings 42 to define terminal edges 44 of the pallet 30 that extend in cantilevered fashion adjacent on of the plurality of legs 38. Advantageously, the wings 42 and adjacent edges that extend in a cantilevered fashion provide a hitch point 55 that may be used to secure stretch wrap. Rolled stretch wrap is hooked to the hitch point 55 and can be easily pulled around the pallet 30 to secure or waterproof items placed on the top panel 54. The hitch point 55 is easier to use owing to the pointed nature of the terminal edges 44, which pierces the stretch wrap thereby allowing the stretch wrap to be pulled without coming loose.

Figure 4:
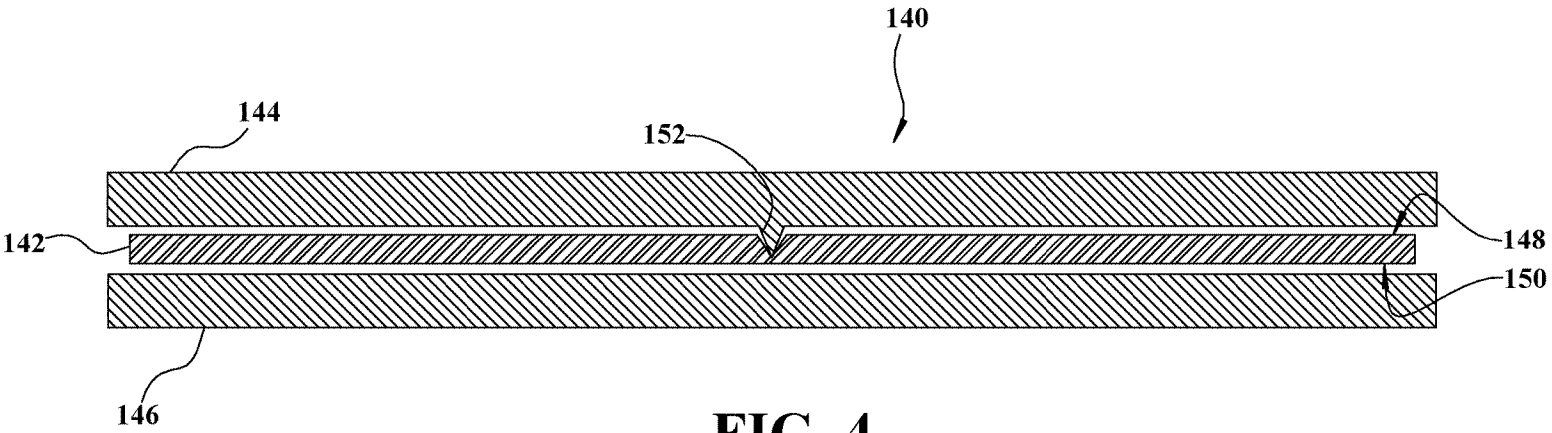
FIG. 4 is a cross-section view of a single-point scored line being formed in a sheet of corrugated cardboard.
Figure 5:
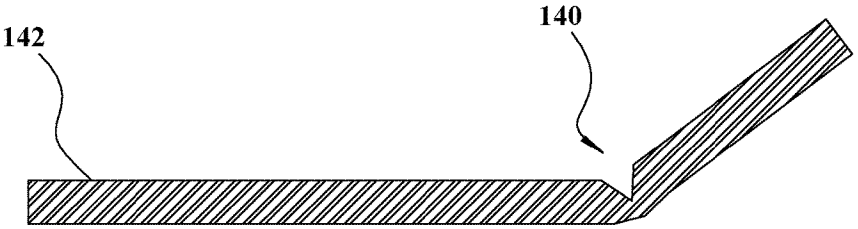
FIG. 5 is a cross-section view of the sheet of corrugated cardboard of FIG. 4 folded along the single-point scored line.

As mentioned above, the scored lines 36 may be any type used for articles constructed with folded corrugated cardboard. Referring to FIG. 4, one type of scored lines used with corrugated cardboard is single-point scores 140. Here, a sheet 142 of corrugated cardboard is sandwiched between two rollers, an upper roller 144 and a lower roller 146. Each sheet 142 includes two opposing surfaces, an upper surface 148 in contact with the upper roller 144 and a lower surface 150 in contact with the lower roller 146. The upper roller 144 includes a pointed male die 152 arranged about a circumference of the upper roller 144. The lower roller 146 may be flat, such as shown here, or may include a female die to receive the male die 152. The male die 152 is generally triangular with an apex extending toward the lower roller 146. As the corrugated sheet 142 passes between the rollers 144, 146 the male die 152 creates a single-point score 140 on the upper surface 148 of the sheet 142. As shown in FIG. 5, single-point scores 140 create a line about which the sheet 142 may be folded in one direction by allowing the upper surface 148 to buckle without tearing the lower surface 150.

Figure 6:
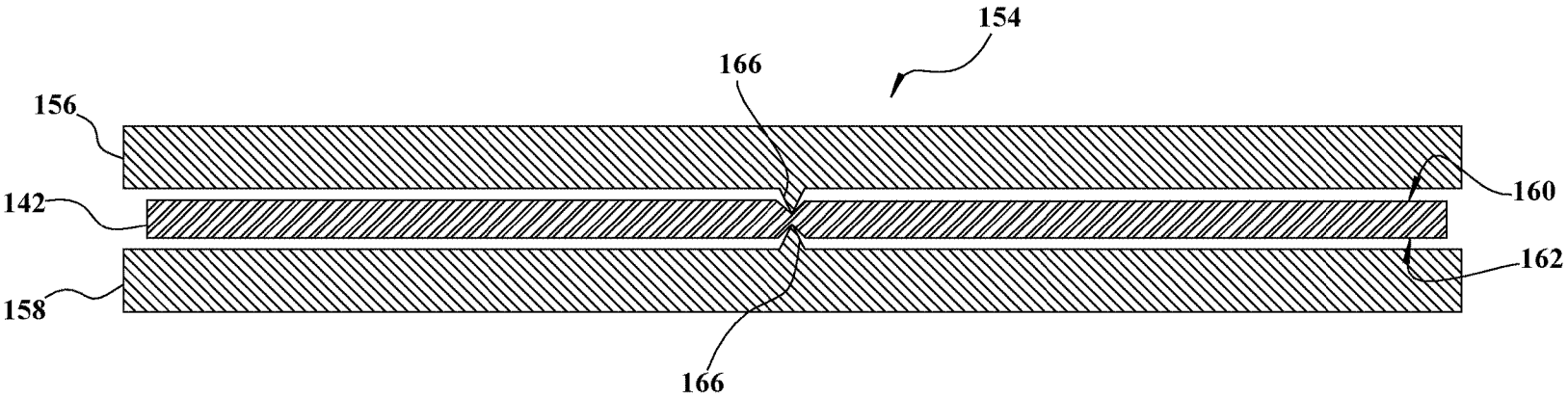
FIG. 6 is a cross-section view of a point-to-point scored line being formed in a sheet of corrugated cardboard.
Figure 7B:
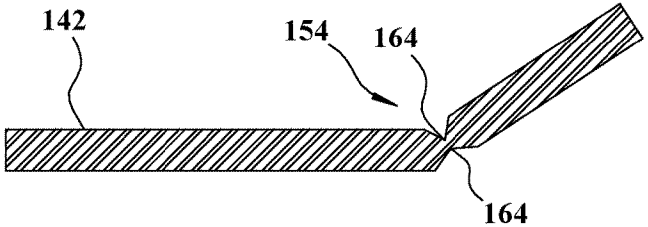
FIG. 7B is a cross-section view of the sheet of corrugated cardboard of FIG. 6 folded in a second direction along the point-to-point scored line.

Alternatively, the scored lines 36 may be point-to-point scores 154, such as shown in FIGS. 6-7B, which facilitate folding the sheet 142 in two directions. Referring to FIG. 6, the sheet 142 or corrugated cardboard is sandwiched between two rollers, an upper roller 156 and a lower roller 158. Each sheet 142 includes two opposing surfaces, an upper surface 160 in contact with the upper roller 156 and a lower surface 162 in contact with the lower roller 158. The point-to-point scores 154 are defined by the upper surface 160 disposed in adjacent relationship with the lower surface 162. Each of the upper surface 160 and the lower surface 162 defines an apex 164 of a triangle with each apex 164 disposed in opposing adjacent relationship with respect to each other.

The upper roller 156 and the lower roller 158 includes a pointed male die 166 arranged about a circumference of each roller 156, 158. Each male die 166 is generally triangular with an apex, with each male die 166 arranged such that respective apexes are arranged in opposing adjacent relationship with the other. As the corrugated sheet 142 passes between the rollers 156, 158 the male die 166 creates a point-to-point score 154 on both the upper surface 160 and the lower surface 162 of the sheet 142.

Figure 7A:
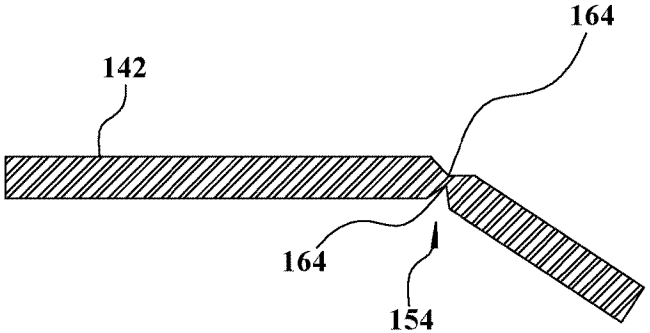
FIG. 7A is a cross-section view of the sheet of corrugated cardboard of FIG. 6 folded in a first direction along the point-to-point scored line.

The point-to-point scores 154 are formed by two male roller elements that cooperate to define the scores in the corrugated cardboard. In this regard, point-to-point scoring may be imparted to the product in the corrugation machine, thereby eliminating any secondary scoring operations that could increase the cost of manufacturing the pallet 30 of the present invention. As shown in FIGS. 7A and 7B, point-to-point scores 154 create a line about which the sheet 142 may be folded in two directions by allowing either of the opposing surfaces 160, 162 to buckle without tearing the other.

To form the body 32 of the pallet 30, the scored sheet 34 is folded along the scored lines 36. As shown in FIG. 8, the sheet 34 must be folded along the scored lines 36A adjacent to the legs 38 and the base wall 40 in a direction opposite of that of the non-adjacent scored lines 36B. In embodiments of the pallet 30 having three legs 38, such as is shown in FIG. 3, four of the scored lines 36A are adjacent to one of the legs 38 and one of the base walls 40. In order to allow the sheet 34 to be folded along the adjacent scored lines 36A in the opposite direction, these scored lines 36A are point-to-point scores 154. In order to further enhance the manufacturing efficiency of the pallet 30, the non-adjacent scores 36B may also be point-to-point scores 154.

During assembly of the pallet 30, the planar top panel 54 is placed on top of the base wall 40 of the body 32. The wings 42 are folded parallel to the base wall 40 and coupled to the top panel 54 using any conventional fastening mechanism, such as an adhesive. The top panel 54 may be formed from one or more layers of corrugated cardboard. Each layer being arranged or stacked together to form the top panel 54. As will be discussed in detail below, the top panel 54 may be defined by a single sheet of corrugated cardboard, multiple sheets of corrugated cardboard, or an individual sheet of corrugated cardboard folded to define each layer. Each of the layers may be coupled to one another during assembly. For example, the layers may be bonded using an adhesive applied between each layer, with staples, or by any other suitable fastening mechanism. Each sheet may be single-wall corrugated cardboard or double-wall corrugated cardboard.

Referring now to FIG. 9, the pallet 30 may further include a plurality of support pedestals 56. Each of the support pedestals 56 is disposed in one of the legs 38 in spaced relationship with respect to each other. The support pedestals 56 provide increased strength to the pallet so as to prevent the legs 38 from buckling when the pallet 30 is loaded with goods by supporting the top panel 54. Each support pedestal 56 defines a height 57. The height 57 of the support pedestals 56 is equal to the height 43 of the legs 38. When the support pedestals 56 extend from the bottom panel 41 of the leg 38 to the top panel 54 the shear strength of the pallet 30 is increased by maintaining perpendicularity of horizontal and vertical portions of the pallet 30.

The pallet 30 may have any number of support pedestals 56 necessary to support the top panel 54. In the embodiment shown, three support pedestals 56 are disposed in each leg 38, for a total of nine support pedestals 38. The support pedestals 56 are generally equally spaced along each leg 38 in order to distribute weight placed on the pallet 30. In some instances, it may be advantageous to space the support pedestals 56 unequally along each leg 38. For example, if the pallet 30 is used to support a load having an unequal weight distribution, the support pedestals 56 may be arranged closer together in areas of greater weight concentration.

In FIGS. 11-16, a second embodiment of the pallet 30 is shown as a two-leg pallet 230. Similar to the embodiment shown in FIG. 1, the pallet 230 includes a body 232 defined by a single sheet 234 of corrugated cardboard. The sheet 234 includes a plurality of scored lines 236 extending parallel with respect to each other. The sheet 234 is folded along the scored lines 236 to define a plurality of legs 38 extending in the direction of the scored lines 236. The sheet further defines at least one base wall 240 extending between each of the legs 238 and a pair of wings 242. The body 232 has a first corrugation direction 237 that may extend perpendicular to the plurality of scored lines 236.

Figure 13:
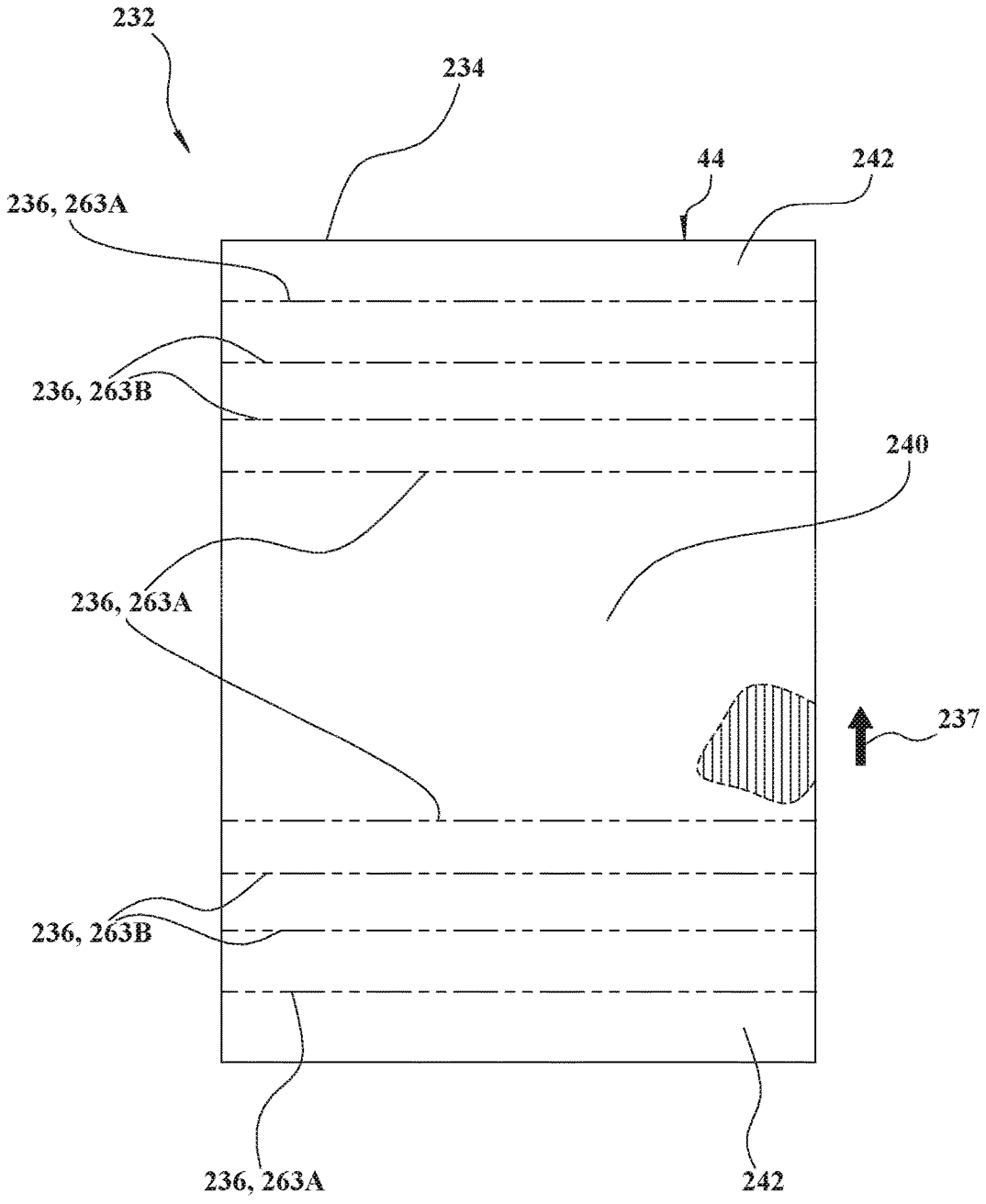
FIG. 13 is a plan view of a sheet of corrugated cardboard with scored lines according to the embodiment of FIG. 11.

As shown in FIG. 13, the plurality of scored lines 236 are formed on the sheet 234 prior to folding. As discussed in more detail above, the scored lines 236 may be point-to-point scored lines. In the embodiment shown, the sheet 234 includes eight scored lines 236. The sheet 234 is folded at each of the scored lines 236 to form the body 232 and to define two legs 238 and a base wall 240. Each leg 238 is formed from four scored lines 236. The scored lines 236 are arranged in groups of four scored lines 36 for each leg 38 that is to be formed. Each leg 238 is defined by a pair of downwardly extending side walls 239 and a bottom panel 241 parallel to the base wall 240. A height 243 of the legs 238 is defined between the bottom panel 241 and the base wall 240. The side walls 239 and bottom panel 241 each extend along the length of the scored lines 236.

Figure 14:
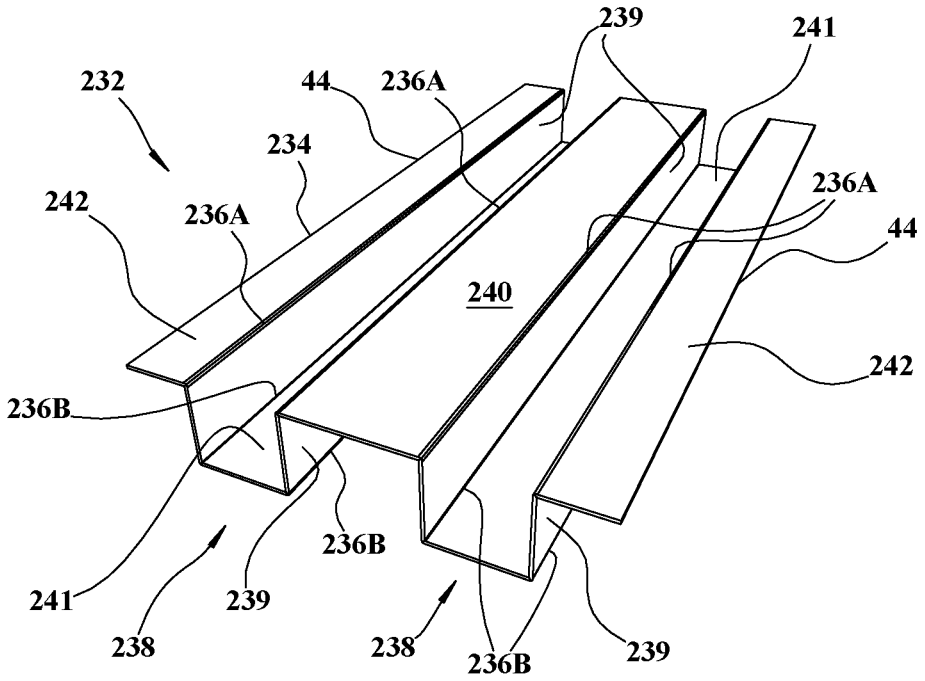
FIG. 14 is a perspective view of a body of a folded corrugated pallet according to the embodiment of FIG. 11.
Figure 15:
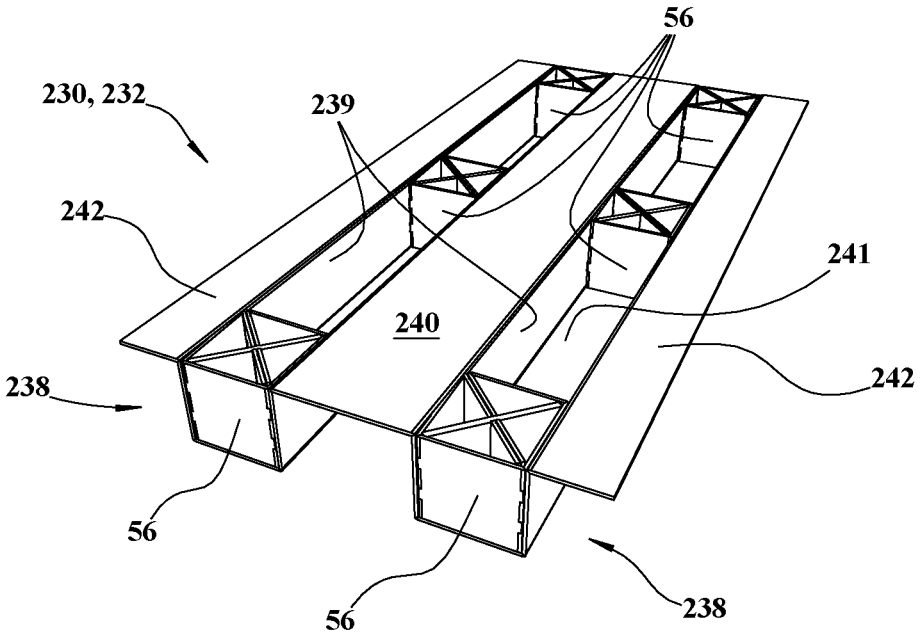
FIG. 15 is an exploded perspective view of a folded corrugated pallet of FIG. 11 including support pedestals.
Figure 16:
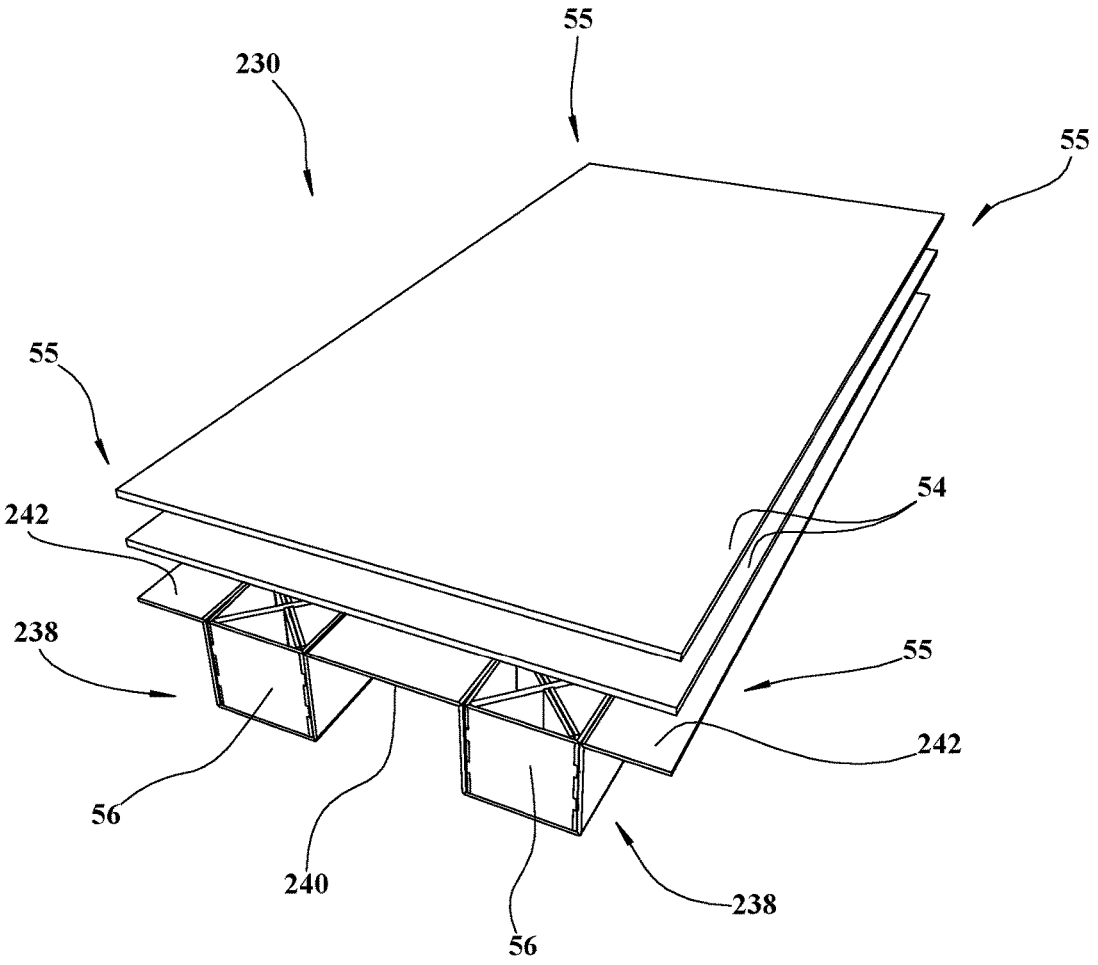
FIG. 16 is an exploded perspective view of the folded corrugated pallet of FIG. 15 including a planar top panel.

Again, similar to the embodiment shown in FIG. 1, to form the body 232 of the two-leg pallet 230, the scored sheet 234 is folded along the scored lines 236. As shown in FIGS. 13 and 14, the sheet 234 must be folded along the scored lines 236A adjacent to the legs 238 and the base wall 240 in a direction opposite of that of the non-adjacent scored lines 236B. In embodiments of the pallet 230 having two legs 238, two of the scored lines 236A are adjacent to one of the legs 238 and one of the base walls 240. In order to allow the sheet 234 to be folded along the adjacent scored lines 236A in the opposite direction, these scored lines 236A are point-to-point scores 154. In order to further enhance the manufacturing efficiency of the pallet 230, the non-adjacent scores 236B may also be point-to-point scores 154.

In some embodiments, the pallet 30 may include other quantities of support pedestals 56. For example, two support pedestals 56 may be disposed in each leg 38, for a total of six support pedestals 56. Alternatively, the pallet 30 may have two legs 38 with three support pedestals 56 disposed in each leg 38, for a total of six support pedestals 56. It is contemplated that any combination of legs 38 and support pedestals 56 may be utilized as necessary to meet specifications for weight capacity.

Figure 18:
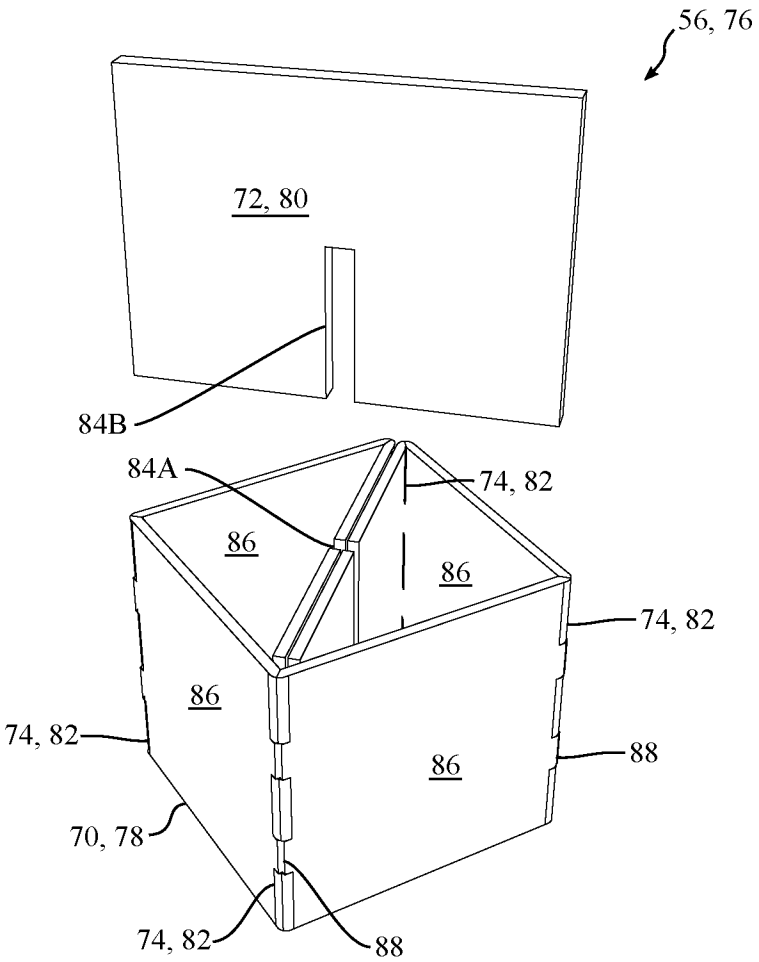
FIG. 18 is an exploded perspective view of a support pedestal including a second support panel.
Figure 17:
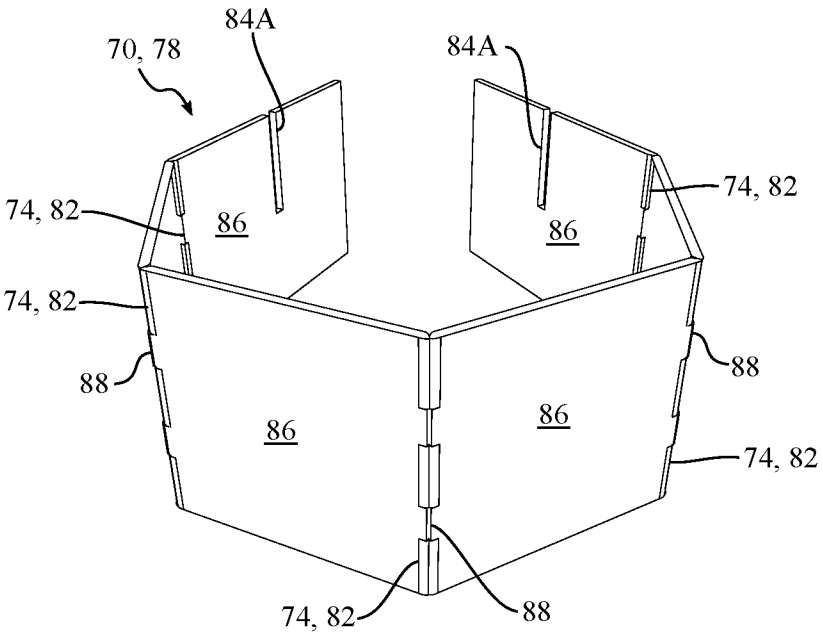
FIG. 17 is a perspective view of one embodiment of a first support panel for a support pedestal.
Figure 19:
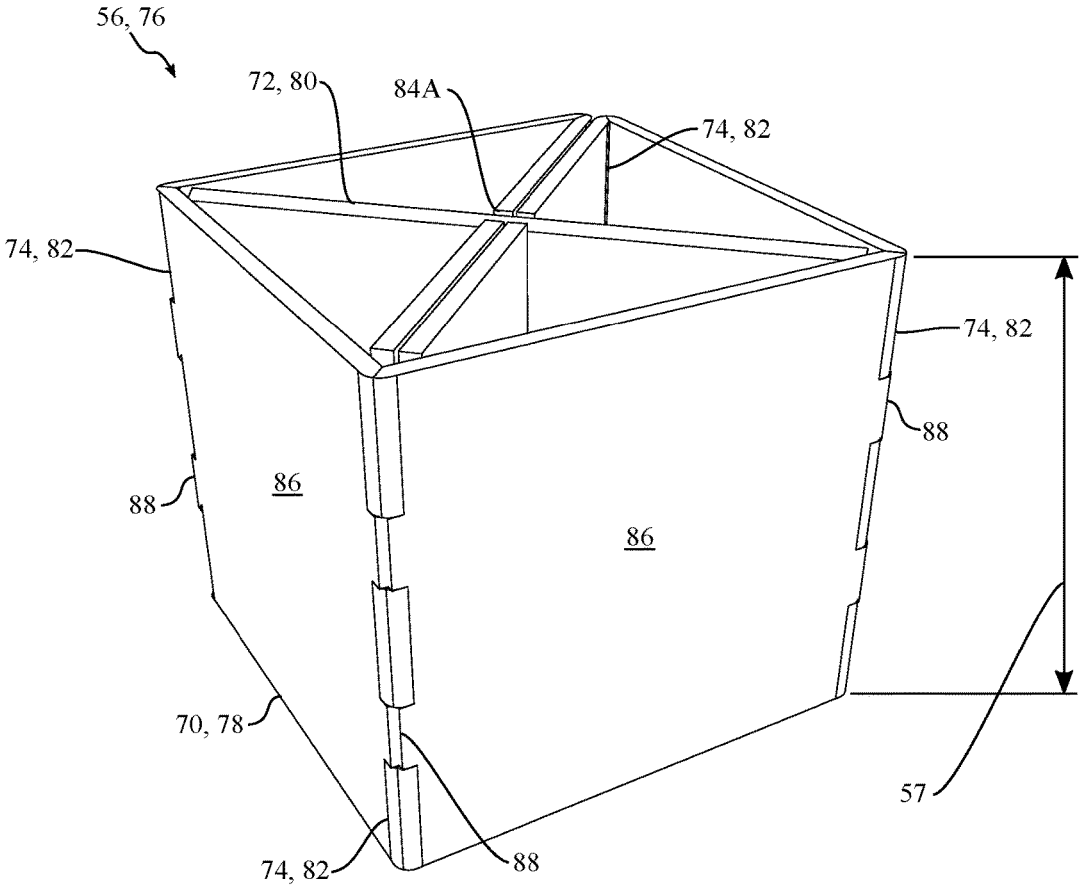
FIG. 19 a perspective view of the support pedestal of FIG. 18.

As will be discussed in greater detail below, each support pedestal 56 may include a first support panel 70 and a second support panel 72. The first support panel 70 has a plurality of scored lines 74 extending parallel with respect to each other. The first support panel 70 is folded along said scored lines 74 to at least partially surround the second support panel 72. Referring now to FIGS. 17-19 one embodiment of the support pedestal 56 is shown as an X-block 76. In this embodiment, the X-block 76 includes a first support panel 78 and a second support panel 80. The first support panel 78 has a plurality of scored lines 82 extending parallel with respect to each other. Each of the first support panel 78 and the second support panel 80 defines a slot 84A, 84B. The scored lines 82 divide the first support panel 78 into six segments 86. The segments 86 are folded toward each other to form a rectangle with two of the segments forming a center cross panel. The second support panel 80 is inserted perpendicular to the two outermost panels 86 such that the slot 84A in the first support panel 78 is intersects with the slot 84B in the second support panel 80. When viewed in cross-section taken along a plane defined parallel to the base wall 40, the first support panel 78 and the second support panel 80 define an X shape.

The first support panel 78 and the second support panel 80 may be formed from corrugated cardboard. The support panels 78, 80 may be formed by die cutting, stamping, or cut with a saw. The slots 84A, 84B may be formed by any of the same processes as the support panels 78, 80. Additionally, the first support panel 78 may include perforations 88 along the scored lines 82 to aid in folding.

Figure 20:
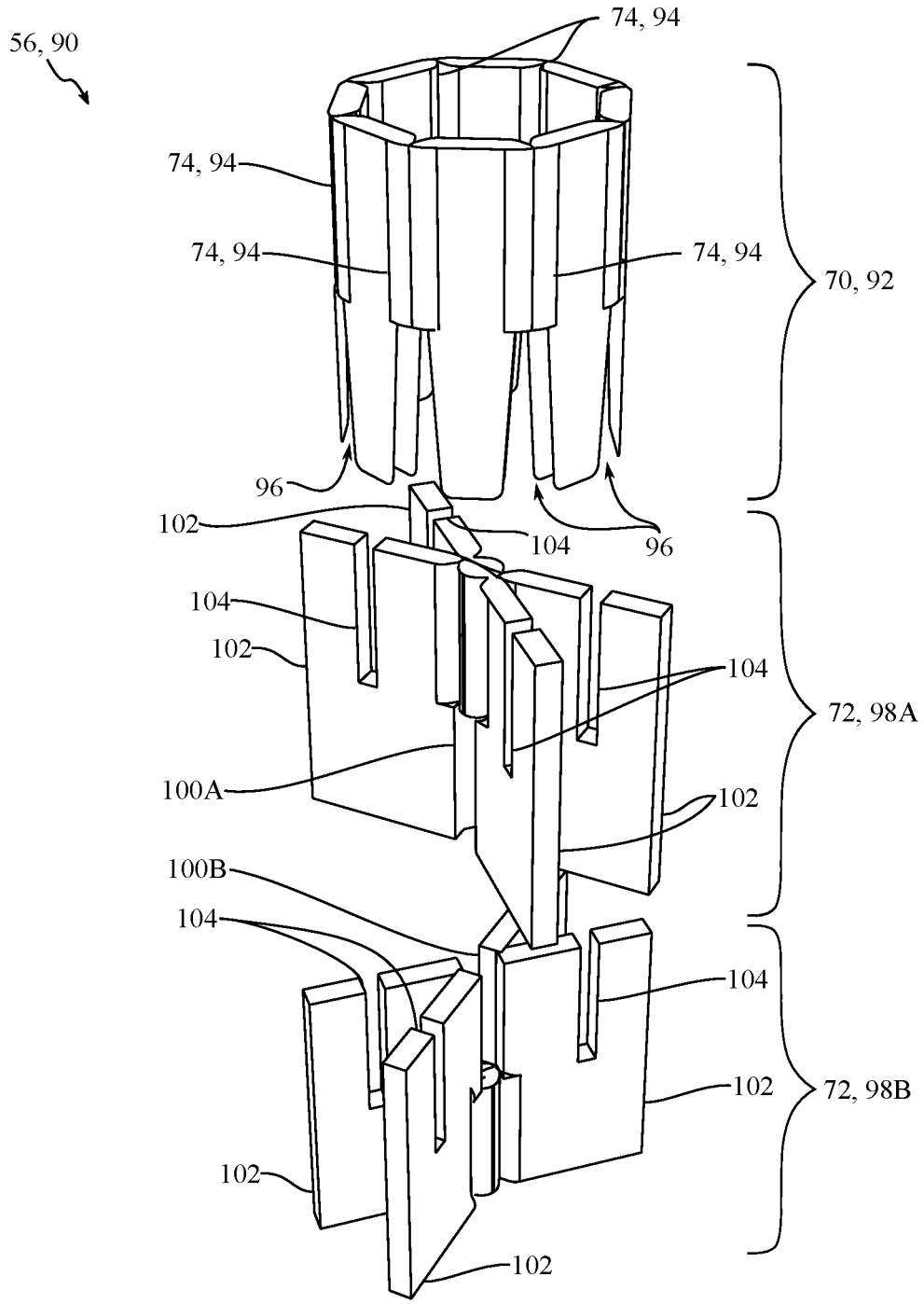
FIG. 20 is an exploded perspective view of another embodiment of a support pedestal including a first support panel and a pair of second support panels.
Figure 22:
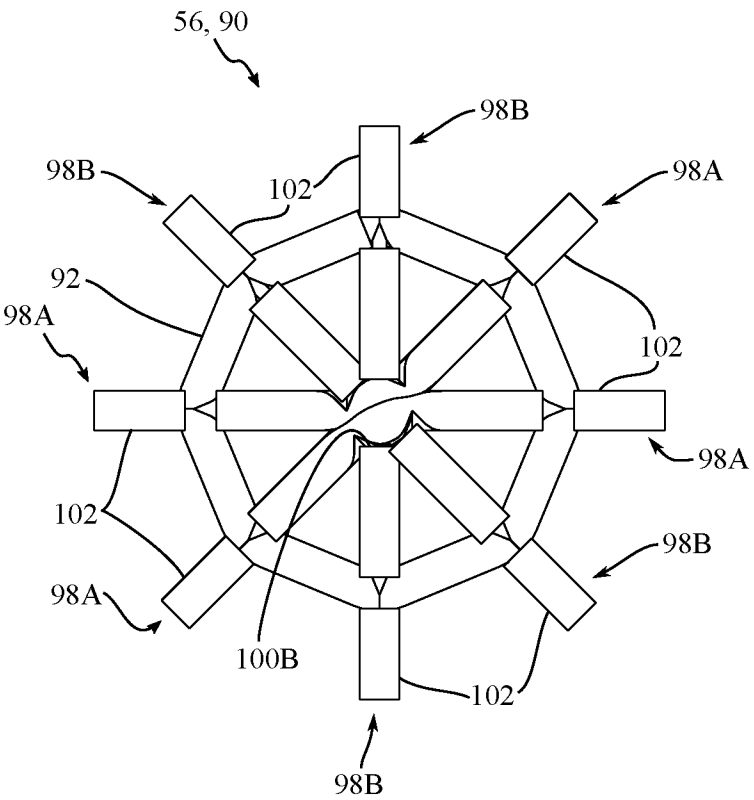
FIG. 22 is a top view of the support pedestal of FIG. 21.
Figure 21:
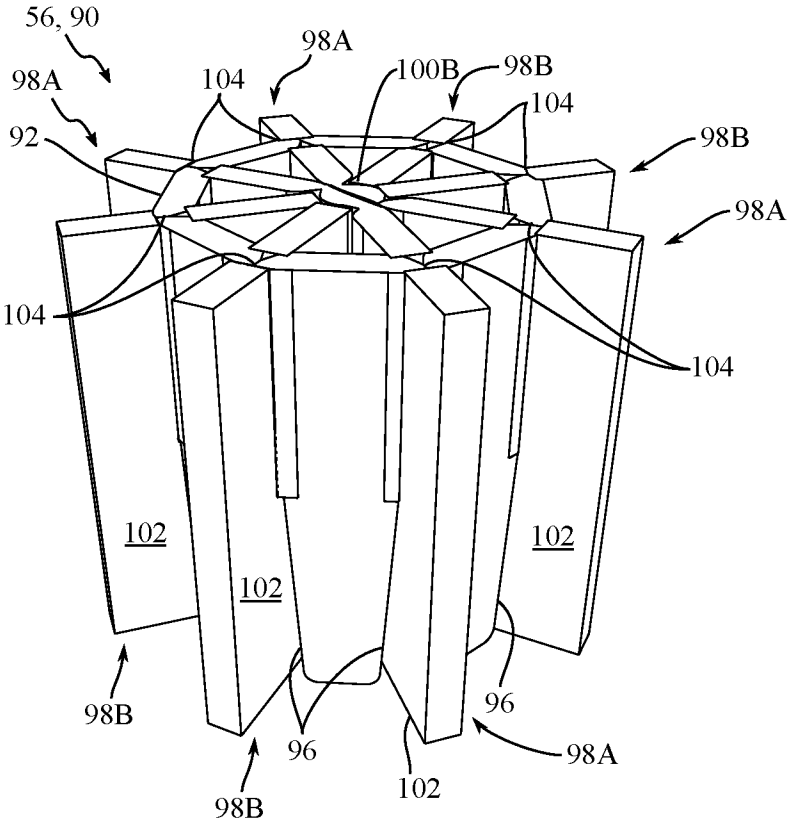
FIG. 21 is a perspective view of the support pedestal of FIG. 20.

Referring now to FIGS. 20-22, another embodiment of the support pedestal 56 is shown. Here, the support pedestal 56 is shown as a star-block 90. The star-block 90 includes a first support panel 92, a second support panel 98A, and a third support panel 98B. Each of the support panels 92, 98A, 98B defines at least one slot. The first support panel 92 has a plurality of scored lines 94 extending parallel with respect to each other. The first support panel 92 defines a plurality of slots 96 with a tapered shape to aid during assembly. Each of the second support panel 98A, and 98B defines at least one slot 100A, 100B. The slot 100A in the second support panel 98A is inserted in the slot 100B in the third support panel 98B to form a cross shape with radially extending arms 102. Each radially extending arm 102 defines a slot 104. The second support panel 98A and the third support panel 98B may each be formed from two sheets of corrugated cardboard arranged adjacent to each other.

The first support panel 92 is folded along the plurality of scored lines 94 to form a generally round shape when viewed in cross-section taken along a plane defined parallel to the base wall 40. The second and third support panels 98A, 98B are inserted into the first support panel 92 such that the slot 104 in each radially extending arm 102 intersects with one of the slots 96 in the first support panel 92.

Figure 23:
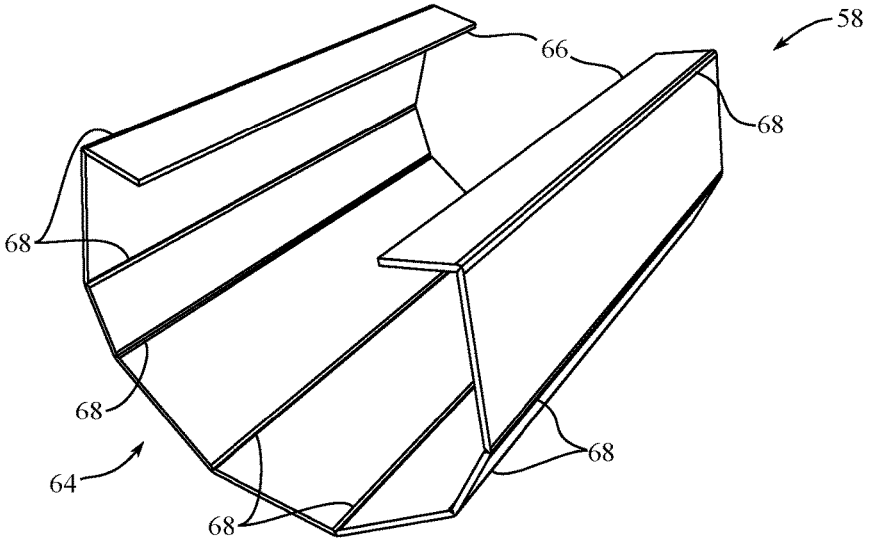
FIG. 23 is a perspective view of a sheet for a support beam with scored lines.
Figure 24:
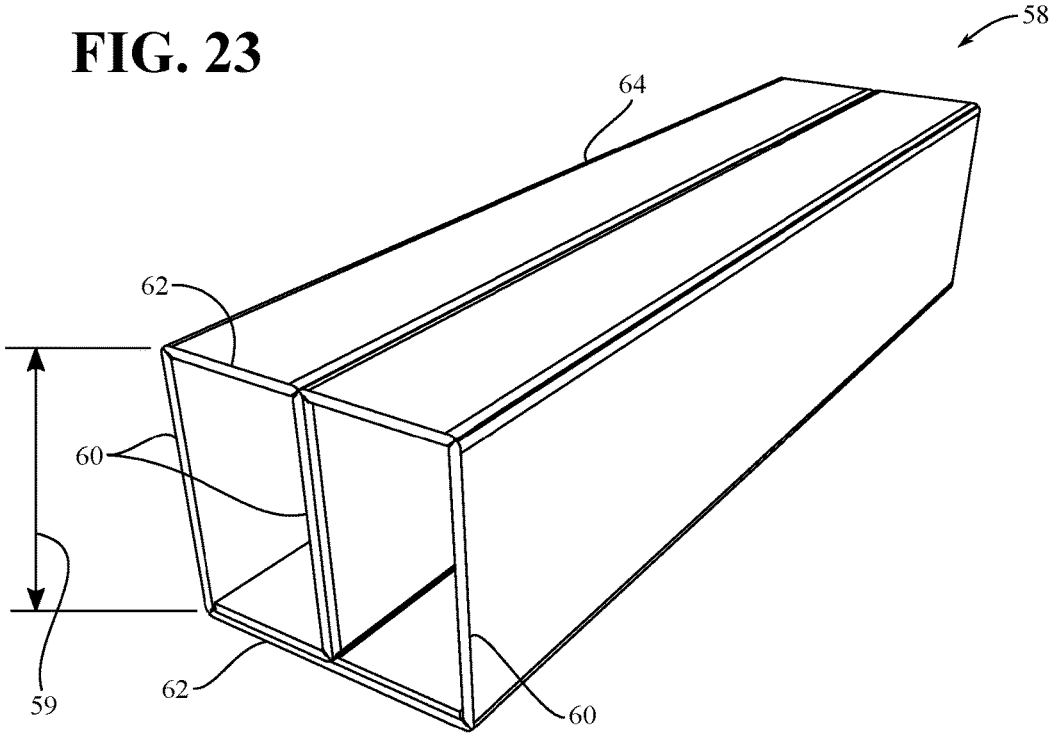
FIG. 24 is a perspective view of the support beam of FIG. 23.

FIGS. 23 and 24 depict a support beam 58 for the pallet 30. A plurality of support beams 58 may be disposed in the legs 38 between the support pedestals 56 and in spaced relationship with respect to each other. The support beams 58 act to locate the support pedestals 56, further supporting the top panel 54, and stabilize the legs 38 when the pallet 30 is loaded with goods. Each support beam 58 may include vertical support walls 60 and horizontal support walls 62. Each support beam 58 defines a height 59. The height 59 of the support beams 58 is equal to the height 43 of the legs 38. When the support beams 58 extend from the bottom panel 41 of the leg 38 to the top panel 54 the shear strength of the pallet 30 is increased by maintaining perpendicularity of horizontal and vertical walls of the pallet 30.

In some scenarios, the forks that are used to lift the pallet 30 may be inserted only partially into the fork channels 48 (i.e. the length of the forks is less than a length of the pallet 30) leaving the base walls 40 unsupported. In these scenarios, unsupported weight on the pallet 30 creates a shear force and a bending moment on the legs 38. These shear forces and bending moment may cause the body 32 and legs 38 to tear. In order to prevent the body 32 and legs 38 from tearing, the support beams 58 are inserted in the leg cavities 52 between the support pedestals 56 during assembly. When viewed from an end, the support beams 58 are generally rectangular with three vertical support walls 60 and two horizontal support walls 62. The vertical support walls 60 prevent the body 32 from tearing due to excessive shear forces. The horizontal support walls 62 prevent the body 32 from tearing due to excessive bending moments.

Each support beam 58 may be formed from a single sheet 64 of corrugated cardboard. Each sheet 64 has two terminal edges 66 and a plurality of scored lines 68 extending parallel with respect to each other and the terminal edges 66. The sheet 64 is folded along the scored lines 68 to define the vertical support walls 60 and the horizontal support walls 62. More specifically, each terminal edge 66 is folded toward the other, and in the same direction, along the scored lines 68. When viewed in an end view, the support beam 58 has one vertical support wall 60 having two layers of corrugated cardboard disposed in adjacent side by side relationship and a part of the horizontal support wall 62 disposed in spaced relationship with respect to each other.

The pallet 30 may have any number of support beams 58 as necessary to support the legs 38. For example, two support beams 58 may be disposed in each leg 38, for a total of six support beams 58. The support beams 58 are generally spaced at an equal distance along each leg 38 in order to equally distribute weight placed on the pallet 30; however, in some instances it may be advantageous to space the support beams 58 at an unequal distance along each leg 38. For example, if the pallet 30 is used with a load having an unequal weight distribution, the support beams 58 may be arranged closer together in areas of greatest weight concentration. Additionally, each support beam 58 may be longer or shorter depending on the specific requirements.

In other embodiments, the pallet 30 may include fewer support beams 58. For example, one support beam 58 may be disposed in each leg 38, for a total of three support beams 58. Alternatively, the pallet 30 may have two legs 38 with two support beams 58 disposed in each leg 38, for a total of four support beams 58. Those having ordinary skill in the art will recognize from the description of the invention as set forth herein that any combination of legs 38 and support beams 58 may be utilized as necessary to meet specifications for weight capacity. Furthermore, the support beams 58 may be omitted in order to reduce cost and weight.

Figure 25:
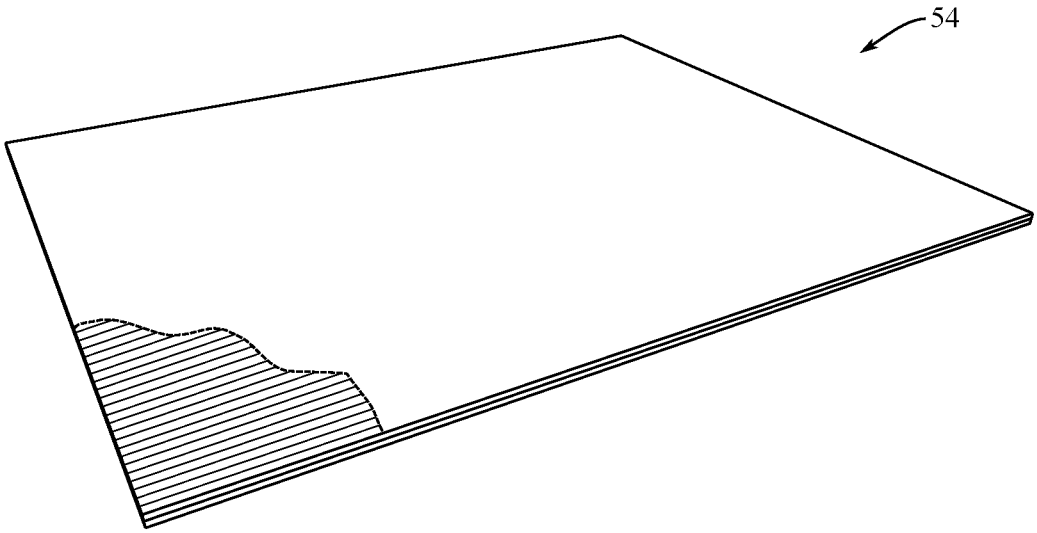
FIG. 25 is a partially cut-away perspective view of a planar top panel and a corrugated inner layer according to one embodiment.
Figure 26:
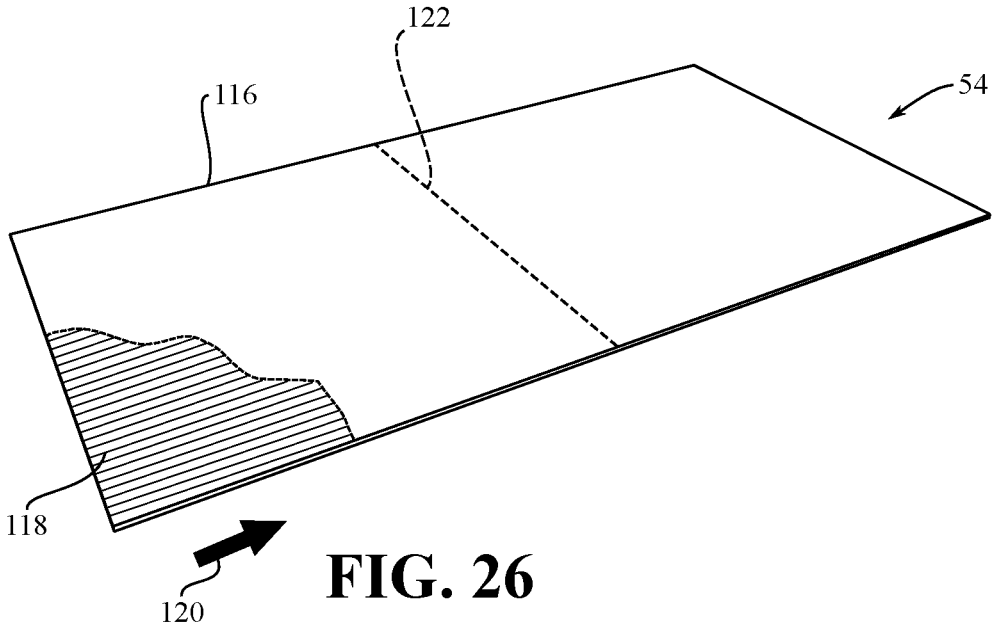
FIG. 26 is a partially cut-away perspective view of a planar top panel and a corrugated inner layer according to another embodiment.
Figure 27:
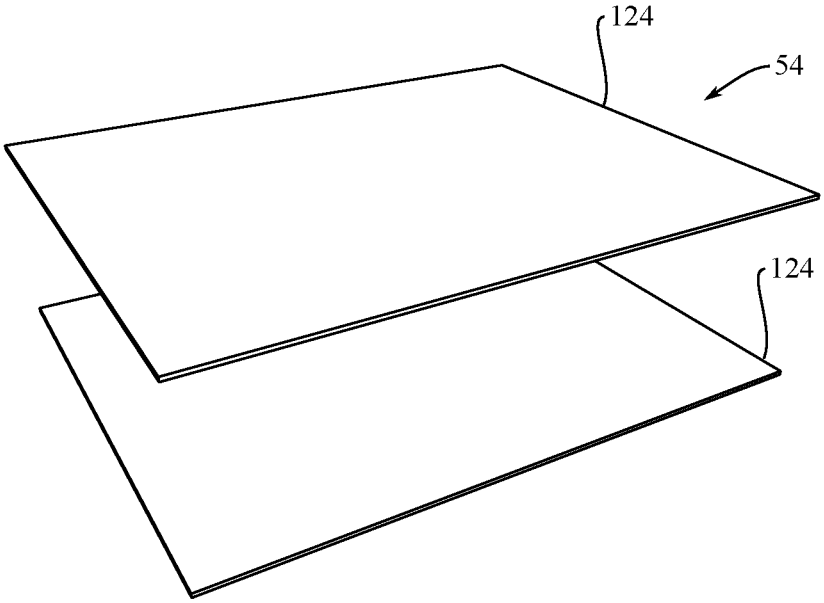
FIG. 27 is a perspective view of a planar top panel according to yet another embodiment.

Several embodiments of the top panel 54 are shown in FIGS. 25-27. Specifically, in FIG. 25, the top panel 54 is shown as a single sheet 116 of corrugated cardboard including a corrugated inner layer 118 having a second corrugation direction 120. The sheet 116 has at least one scored line 122 extending perpendicular to the second corrugation direction 120. The top panel 54 is folded along the at least one scored line 122 to create two layers. It should be appreciated that additional scored lines 122 would be used to form a top panel 54 with more than two layers.

Another embodiment of the top panel 54 is shown in FIG. 26. Here, the top panel 54 includes two sheets 124 of corrugated cardboard stacked together. The sheets 124 may be bonded to each other using an adhesive, such as glue, applied between each sheet 124. The sheets 124 may also be coupled together using staples, other fasteners, or a combination of fasteners and adhesive. Each sheet 124 may be single wall corrugated cardboard, having a single corrugated inner layer and two flat outer layers. Alternatively, each sheet 124 may be double wall corrugated cardboard, having two corrugated inner layers separated by a flat inner layer, and two flat outer layers.

The pallet 30 is assembled by first folding the sheet 34 along the plurality of scored lined 36 as discussed above to form the body 32. The plurality of support pedestals 56 are each assembled and inserted in the legs 38. An adhesive, such as glue, is used to secure the support pedestals 56. The support beams 58 may be inserted in the legs 38 between the support pedestals 56 and secured with glue. Next, adhesive is applied to the base walls 40 and the top panel 54 is secured to the body 32.

As mentioned above, the body 32 may have a first corrugation direction 37 and the top panel 54 may have a second corrugation direction 120. The pallet 30 may be assembled with the first corrugation direction 37 parallel with the second corrugation direction 120. Alternatively, the pallet 30 may be assembled with the first corrugation direction 37 perpendicular to the second corrugation direction 120.

In FIG. 8, a plurality of apertures 130 that may be defined in the body 32 of the pallet 30 are shown. The apertures 130 are arranged such that when the body 32 is folded along the scored lines 32, the apertures 130 define at least one side channel 132 extending through the leg side walls 39 and perpendicular to the legs 38. The side channel 132 is configured to allow forks or strapping to be placed under the top panel 54 and across the fork channels 48. The side channels 132 increase usability of the pallet 30 by providing a passage for strapping when securing items to the pallet 30. The apertures 130 may be die cut in the body 32 prior to folding.

While several options have been suggested to secure each part of the pallet 30 during assembly, an adhesive such as glue is particularly advantageous. The strength of the pallet 30 is increased, and in turn, the pallet's 30 reusability. When the top panel 54 is secured to the base walls 40 and the wings 42, the sheet 34 of the body 32 wraps around the support pedestals 56. By wrapping, the sheet 34 is placed in tension, preventing movement of support pedestals 56 and preventing the base walls 40 from bending. When goods are placed on top of the top panel 54 of the pallet 30, the weight of the goods is supported by the tension in the sheet 34. Owing to the high shear-strength of glue, the tension in the sheet 34 is maintained, allowing the pallet 30 to support increased weight.

Advantages of the corrugated pallet 30 over the prior art include increased strength and durability, as well as reduced weight and cost of manufacture. The increased strength allows the pallet 30 to utilize a lightweight construction and a greater weight capacity. The lightweight construction enables a person to move an empty pallet 30 without additional equipment such as a pallet jack. Furthermore, the increased durability allows the pallet 30 to be reused several times, reducing costs and waste. By using sheets of corrugated cardboard in commercially standard sizes with minimal additional processing, the pallet 30 is able to be produced at a lower cost. The increased strength affords the pallet a greater weight capacity. The greater weight capacity allows the pallet to be used in place of more expensive wood pallets. The increased durability allows the pallet to be reused several times, which reduces costs and waste from disposed pallets. Finally, the corrugated pallets of the type contemplated by the present invention are recyclable at the end of their useful life, thereby drastically reducing the environmental impact of this material handling component.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A folded corrugated pallet comprising:

a body defined by a single sheet of corrugated cardboard, said sheet includes a plurality of scored lines extending parallel with respect to each other, said sheet folded along said scored lines to define a plurality of legs extending in the direction of said scored lines, at least one base wall extending between each of said legs, and a pair of wings;

each of said wings extend parallel to said scored lines and away from each other when said wings are folded parallel to said base wall;

a planar top panel of corrugated cardboard disposed on top of said wings and said base wall, said planar top panel and said wings cooperate to define terminal edges of the pallet that extend in cantilevered fashion adjacent one of said plurality of legs; and a plurality of support pedestals, said support pedestals disposed in said legs in spaced relationship with respect to each other, said support pedestal including a first support panel having a plurality of scored lines extending parallel with respect to each other and a second support panel, said first support panel folded along said scored lines to at least partially surround said second support panel, and wherein each of said first support panel and said second support panel defines a slot, said slot in said first support panel intersecting with said slot of said second support panel, said first support panel and said second support panel define an X shape with respect to each other when viewed in cross-section taken along a plane defined parallel to said base wall.

2. The folded corrugated pallet as set forth in claim 1, wherein each of said legs includes a bottom panel parallel to said base wall and a height is defined between said bottom panel and said base wall, and wherein said support pedestals define a height with said height of said support pedestals equal to said height between said bottom panel of said legs and said base wall.

3. The folded corrugated pallet as set forth in claim 1, wherein said support pedestal further includes a third support panel with each of said support panels defining at least one slot, said slot in said second support panel intersecting with said slot in said third support panel to form radially extending arms each defining a slot, and said slot in each of said radially extending arms intersecting with one of said slots in said first support panel.

4. The folded corrugated pallet as set forth in claim 1, wherein said plurality of scored lines is further defined as twelve scored lines, said sheet folded along said scored lines to define three legs.

5. The folded corrugated pallet as set forth in claim 4, wherein said base wall is further defined as a first base wall and a second base wall and said legs are further defined as a pair of outer legs and a center leg located between said outer legs, said first base wall extending between one of said outer legs and said center leg and said second base wall extending between the other of said outer legs and said center leg.

6. The folded corrugated pallet as set forth in claim 4, wherein at least six of said plurality of scored lines are point-to-point scores defined by opposing surfaces in adjacent relationship with respect to each other with each of said point-to-point scores adjacent to one of said plurality of legs.

7. The folded corrugated pallet as set forth in claim 1, with said opposing surfaces of said sheet of corrugated cardboard each defining an apex of a triangle with each apex disposed in opposing adjacent relationship with respect to each other.

8. The folded corrugated pallet as set forth in claim 4, further including a plurality of support pedestals, with three support pedestals disposed in each of said legs in spaced relationship with respect to each other.

9. The folded corrugated pallet as set forth in claim 1, wherein said plurality of scored lines is further defined as eight scored lines, said sheet folded along said scored lines to define two legs.

10. The folded corrugated pallet as set forth in claim 9, wherein at least four of said plurality of scored lines are further defined as point-to-point scores with each of said point-to-point scores adjacent to one of said plurality of legs.

11. The folded corrugated pallet as set forth in claim 9, further including a plurality of support pedestals, with three support pedestals disposed in each of said legs in spaced relationship with respect to each other.

12. The folded corrugated pallet as set forth in claim 1, wherein said planar top panel is coupled to said wings and to said at least one base wall.

13. The folded corrugated pallet as set forth in claim 12, wherein an adhesive is disposed between said planar top panel and said wings and between said planar top panel and said at least one base wall to secure said planar top panel to said body.

14. The folded corrugated pallet as set forth in claim 1, wherein said planar top panel is defined by two layers of corrugated cardboard.

15. The folded corrugated pallet as set forth in claim 1, wherein said planar top panel comprises double-wall corrugated cardboard.

16. The folded corrugated pallet as set forth in claim 1, wherein a plurality of apertures are defined in said body such that when said body is folded along said scored lines said apertures define at least one side channel extending through and perpendicular to said legs.

17. The folded corrugated pallet as set forth in claim 16, wherein said at least one side channel is spaced upwardly from a bottom panel of said legs.

18. The folded corrugated pallet as set forth in claim 16, wherein said at least one side channel is further defined as two side channels with each of said side channels disposed in a spaced relationship with respect to said support pedestals.

19. A folded corrugated pallet comprising:

a body defined by a single sheet of corrugated cardboard, said sheet includes a plurality of scored lines extending parallel with respect to each other, said sheet folded along said scored lines to define a plurality of legs extending in the direction of said scored lines, at least one base wall extending between each of said legs, and a pair of wings;

each of said wings extend parallel to said scored lines and away from each other when said wings are folded parallel to said base wall;

a planar top panel of corrugated cardboard disposed on top of said wings and said base wall, said planar top panel and said wings cooperate to define terminal edges of the pallet that extend in cantilevered fashion adjacent one of said plurality of legs; and a plurality of support pedestals, said support pedestals disposed in said legs in spaced relationship with respect to each other, said support pedestal including a first support panel having a plurality of scored lines extending parallel with respect to each other and a second support panel, said first support panel folded along said scored lines to at least partially surround said second support panel, and wherein said support pedestal further includes a third support panel with each of said support panels defining at least one slot, said slot in said second support panel intersecting with said slot in said third support panel to form radially extending arms each defining a slot, and said slot in each of said radially extending arms intersecting with one of said slots in said first support panel.

* * * * *